United States Patent [19]

Kanno et al.

[11] Patent Number: 4,538,898

[45] Date of Patent: Sep. 3, 1985

[54] DEVELOPING DEVICE

[75] Inventors: Fuchio Kanno, Yokohama; Toshio Kaneko; Koji Sakamoto, both of Tokyo, all of Japan

[73] Assignee: Ricoh Company, Ltd., Japan

[21] Appl. No.: 440,713

[22] Filed: Nov. 10, 1982

[30] Foreign Application Priority Data

| | | | |
|---|---|---|---|
| Nov. 10, 1981 | [JP] | Japan | 56-178968 |
| Nov. 18, 1981 | [JP] | Japan | 56-183659 |
| Nov. 18, 1981 | [JP] | Japan | 56-183658 |
| Dec. 12, 1981 | [JP] | Japan | 56-200342 |
| Dec. 30, 1981 | [JP] | Japan | 56-211533 |

[51] Int. Cl.[3] ..... G03G 15/08

[52] U.S. Cl. ..... 355/3 DD

[58] Field of Search ..... 355/3 DD, 14 D, 3 CH; 118/653, 639, 652, 689; 430/35, 120; 427/203, 205

[56] References Cited

U.S. PATENT DOCUMENTS

| | | | |
|---|---|---|---|
| 4,154,520 | 5/1979 | Nishikawa et al. | 355/3 DD |
| 4,321,886 | 3/1982 | Azuma | 118/689 |
| 4,332,467 | 6/1982 | Kimura et al. | 355/14 D |
| 4,348,979 | 9/1982 | Daintrey | 355/3 DD X |
| 4,395,110 | 7/1983 | Hosono et al. | 355/3 DD |

*Primary Examiner*—A. C. Prescott

*Attorney, Agent, or Firm*—Guy W. Shoup

[57] ABSTRACT

A developing device for developing an electrostatic latent image includes a tank for containing therein a quantity of developer, a developing sleeve driven to rotate in a predetermined direction and having an outer peripheral surface which defines a path for transporting the developer, a magnet roll disposed inside of the developing sleeve for keeping the developer attracted to the peripheral surface of the sleeve, and a pressure plate pressed against the sleeve to form a thin film of developer on the peripheral surface of the sleeve before being applied to the latent image.

23 Claims, 27 Drawing Figures

DEVELOPING DEVICE

BACKGROUND OF THE INVENTION

1. Field of the Invention

This invention relates to a developing device for visualizing an electrostatic latent image formed on an image carrying member with a color material such as toner, and in particular to a developing device including a developer carrying member on which a thin film of developer such as toner is first formed, which is then applied to an electrostatic latent image to effectuate visualization of the latent image.

2. Description of the Prior Art

Developing devices using toner to develop the electrostatic latent image for use in various types of recording machines such as an electrophotographic copying machine and electrostatic recording machine are well known in the art. These developing devices may be generally categorized into two different systems: a single component developer system in which use is made of a single component developer comprised of magnetic toner particles and a duplex component developer system in which use is made of a duplex component developer comprised of toner particles and carrier beads. In either system, it is often required to form a film of developer having a controlled thickness, in particular an extremely thin film in some cases, before application to an electrostatic latent image so as to attain a desired developing performance.

The single component developer system has recently attracted a wide attention because of its potential capability in simplification in the overall device structure as well as enhanced reliability and performance in developing process as compared with the conventional duplex component developer system. In general, there are two developing methods in the single component developer system. One of them is the induction type developing method which uses toner particles of relatively low resistivity. In this method, when a thin film of toner particles is brought against an electrostatic latent image, charges opposite in polarity to the latent image are induced in those toner particles positioned opposite to the latent image and those toner particles charged oppositely by induction are then attracted to the latent image to effectuate development of the latent image.

The other developing method is the charging type developing method which uses toner particles of relatively high resistivity. In this method, a thin film of toner particles charged opposite in polarity to an electrostatic latent image to be developed is first formed and then brought into contact or proximity of the latent image to cause selective transfer of the toner particles to the latent image. This second method of charging type has numerous advantages and it has been expected to be able to produce a developed image of excellent quality which is almost as good as the one obtained by using a duplex component developer. However, an obstacle has existed in putting the charging type method in practical usage. That is, in order to attain an excellent developing performance, individual toner particles must be charged uniformly, and in order to attain such uniform charging, a film of toner particles must be made thinner, i.e., below the thickness of 4–5 particles stacked one on top of another or 50 microns or less for commonly sized toner particles. A major difficulty has resided in forming such a thin film of toner particles which is uniform in thickness as well as in charging.

SUMMARY OF THE INVENTION

A primary object of the present invention is to obviate the above-described disadvantages of the prior art and to provide an improved developing device for developing an electrostatic latent image.

Another object of the present invention is to provide a developing device capable of producing a developed image of excellent quality even with the use of a single component developer.

A further object of the present invention is to provide a developing device which is reliable in operation.

A still further object of the present invention is to provide a developing device including a developer carrying member on which a thin film of uniformly charged developer may be made consistently prior to application to an electrostatic latent image to be developed.

A still further object of the present invention is to provide a developing device particularly suited for use in a recording machine such as an electrophotographic copying machine or electrostatic recording machine.

A still further object of the present invention is to provide a developing device which is simple in structure and thus easy to manufacture.

Other objects, advantages and novel features of the present invention will become apparent from the following detailed description of the invention when considered in conjunction with the accompanying drawings.

DESCRIPTION OF THE PREFERRED EMBODIMENTS

Figure 1:
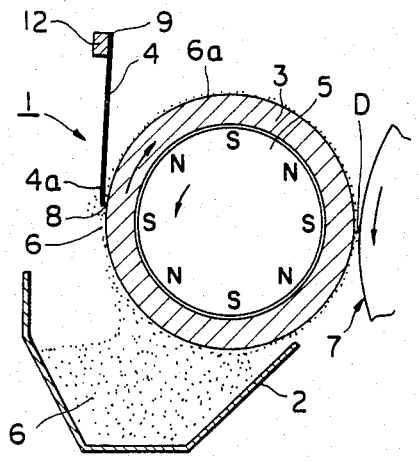
FIG. 1 is a schematic illustration useful for explaining the principle of forming a thin film of charged developer on a sleeve-shaped developer carrying member prior to application to an electrostatic latent image.

Referring now to FIG. 1, there is illustrated a developing device 1 adapted for use in an electrophotographic copying machine. The developing device 1 comprises a tank 2 for containing therein a quantity of developer, a sleeve-shaped developer carrying member (also referred to as "developing sleeve" hereinafter) 3 comprised of a non-magnetic material, a pressure blade or plate 4 disposed in pressure contact with the peripheral surface of the developing sleeve 3 for controlling the thickness of a film of developer formed thereon and a magnetic roller 5 disposed inside of the developing sleeve 3 and having opposite magnetic poles in an alternate arrangement along the circumference spaced apart from each other. In this embodiment, the developer 6 contained in the tank 2 is a single component developer comprised of magnetic toner particles of high resistivity. It is so structured that the sleeve 3 is driven to rotate clockwise and the magnetic roll 5 counterclockwise as shown in FIG. 1. A drum-shaped photosensitive member 7 carrying thereon an electrostatic latent image is disposed in the close proximity to and in parallel with the developing sleeve 3. It is to be noted, however, that use may be also made of an endless belt type or sheet type photosensitive member instead of the drum type as shown.

The pressure plate 4 is formed by a thin plate of magnetic material having sufficient resiliency, and, importantly, it is disposed with its forward (or bottom) end 8 directed counter to the rotating direction of the developing sleeve 3. In the structure shown in FIG. 1, the forward end 8 of the pressure plate 4 is pressed against the sleeve 3 with toner particles sandwiched therebetween. The base end 9 of the pressure plate 4 is fixedly attached to a machine housing (not shown). The pressure plate 4 is wide enough to traverse the entire width of the developing sleeve 3.

In operation, the photosensitive drum 7 is driven to rotate in the counterclockwise direction indicated by the arrow, during which an electrostatic latent image is formed on the peripheral surface of the drum 7 by any well known method. And, the thus formed latent image is moved to a developing region D defined at the location where the developing sleeve 3 and the photosensitive drum 7 come closer as the drum 7 rotates.

On the other hand, in the developing device 1, the developing sleeve 3 is driven to rotate clockwise and the magnet role 5 is driven to rotate counterclockwise so that the toner particles 6 in the tank 2 are partly and successively transported as carried on the peripheral surface of the sleeve 3 in the counterclockwise direction. The toner particles thus transported move past the gap between the pressure plate 4 and the sleeve 3. Since the pressure plate 4 is made of a magnetic material, it is attracted toward the sleeve 3 due to the magnetic force of the magnet role 5 disposed rotatably inside of the sleeve 3. Thus, the forward end portion 8 of the pressure plate 4 presses the toner particles against the sleeve 3 which move past the gap therebetween. For this reason, the amount of toner particles transported through the gap between the sleeve 3 and the pressure plate 4 is controlled by such a pressing function and thus a thin film 6*a* of toner particles having a desired thickness may be formed on the developing sleeve 3 in the downstream of the thickness controlling gap.

As described above, since the forward end 8 of the pressure plate 4 is directed counter to the rotating direction of and pressed against the developing sleeve 3, a larger portion of the toner particles attracted and deposited on the sleeve 3 is scraped off thereby allowing to effectively form an extremely thin film of toner particles. This is a main advantage resulting from the counter arrangement of the forward end 8 of the pressure plate 4 with respect to the direction of rotation of the developing sleeve 3. Moreover, since the pressure plate has sufficient resiliency, the forward end 8 of the pressure plate 4 may be pressed against the sleeve 3 along its entire width so that the toner film 6*a* having a uniformly thin thickness along the entire longitudinal length or width of the developing sleeve 3 may be obtained.

The thus formed toner film 6*a* is transported to the developing region D as the sleeve 3 rotates clockwise, where the toner particles forming the film 6*a* are selectively attracted to the electrostatic latent image formed on the photosensitive drum 7 thereby the latent image is visualized by the attracted toner particles. For effective transfer of the selected toner particles to occur at the developing region D to form a developed image of excellent quality, the toner particles forming the film 6*a* must be charged sufficiently as well as uniformly. Charging of the toner particles may be carried out by any well known method, for example, frictional charging between the sleeve 3 and the toner particles or between the pressure plate 4 or any other member (not shown) and the toner particles, or irradiation of corona ions by a corona discharger (not shown). Whatever method is used to charge the toner particles, it is insured that the toner particles forming the thin film 6*a* are charged uniformly because the film 6*a* is made extremely thin and uniform by the pressure plate 4. The toner particles 6 must have the volume resistivity of typically $10^{10}$ ohm.cm or more, or preferably $10^{13}$–$10^{15}$ ohm.cm or more.

The visualized image thus produced on the photosensitive drum 7 is then transferred to a transfer material and the transferred image is fixed to the transfer material. On the other hand, the toner particles remaining on the developing sleeve 3 after passing through the developing region D are returned to the tank 2 and will be reused in subsequent operations.

In principle, the structure shown in FIG. 1 operates in the manner described above to develop a latent image with magnetic toner particles. However, since the forward end 8 of the pressure plate 4 is so located that it is attracted to the sleeve 3, some toner particles 6 will be deposited on the back side 4*a* of the forward end portion 8 of the pressure plate 4 to form a heap. If such a heap becomes substantial, the forward end 8 of the pressure plate 4 will be more strongly attracted to the sleeve 3. This tends to cause irregularities in the thickness of the toner film 6*a* and thus the charging state thereof. To make the matter worse, because of the increased pressing force, the toner particles 6 passing between the pressure plate 4 and the sleeve 3 are partly heated and become stuck to the plate 4. If this happens, the toner film 6*a* becomes streaky with valleys extending along the circumferential direction of the sleeve 3. With such a streaky toner film 6*a*, only a developed image of extremely poor quality may result.

Figure 2:
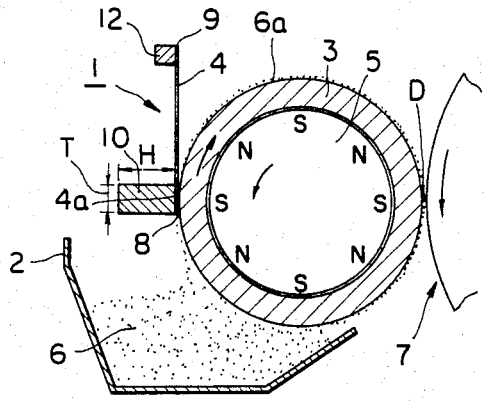
FIGS. 2 through 7 are schematic illustrations showing several embodiments of the present invention provided with means for preventing accumalation of developer at the forward end of the pressure plate thereby allowing to form a thin film of uniformly charged developer consistently.

FIG. 2 shows one embodiment of the present invention which is capable of obviating the above-described problem. As shown, the structure of FIG. 2 includes a deposition preventing member 10 for preventing deposition of toner particles on the back side of the pressure plate 4. The deposition preventing member 10 is provided at or in the vicinity of the forward end 8 and extending across the entire width of the pressure plate 4. With the provision of such a toner deposition preventing member, the pressing force of the pressure plate 4 may be maintained substantially at a predetermined level at all times thereby allowing to form the toner film 6*a* of uniform thickness and charging without streaks.

It is to be noted that the deposition preventing member 10 may be formed by any desired material, magnetic or non-magnetic for that matter, and in any desired shape. However, the experimental results have shown that preferable results may be obtained in the case (1) where use is made of a block of Bakelite(trademark) having height H of 4 mm, thickness T of 1 mm and length equal to the total width of the pressure plate 4 as fixedly adhered to the forward end portion 8 of the pressure plate; in the case (2) where use is made of a block of sponge having height H of 4 mm, thickness T of 4 mm and length equal to the total width of the pressure plate 4 as fixedly adhered to the forward end portion 8 of the pressure plate 4; and in the case (3) where use is made of a block of rubber of the same size as and provided in the same manner as in the above case (2).

Figure 3:
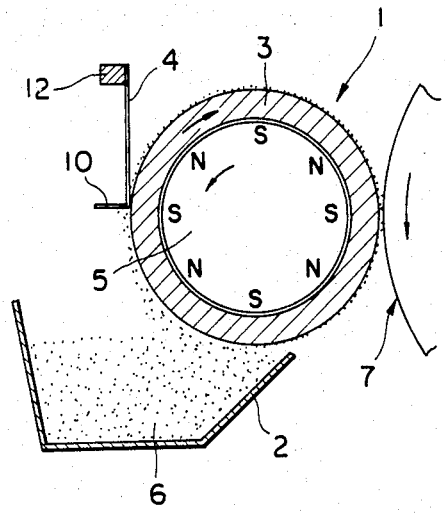

As shown in FIG. 3, it is to be further noted that the member 10 may be formed integrally with the pressure plate 4. In the event where the member 10 is separately formed and then fixedly adhered to the pressure plate 4 with the use of an adhesive, it is preferable to use such an adhesive which may retain streachability or elasticity when dried. Otherwise, the pressure plate 4 would loose elasticity to some extent, which could be a reason for causing irregularities in thickness and/or a charging state of the resulting toner film 6*a*.

In the structure illustrated in FIG. 1, apart from the problem of deposition of toner particles on the back side of the pressure plate 4, there exists another problem of increasing accumulation or stagnation of toner particles 6 around or in the vicinity of the forward end 8 of the pressure plate 4 as the operation proceeds. As the volume of the stagnating toner particles 6 increases, the pressure plate 4 will increase its pressing force to deviate from a predetermined level thereby hindering to obtain a desired toner film 6*a* and bring about the drawbacks as described above.

Figure 4:
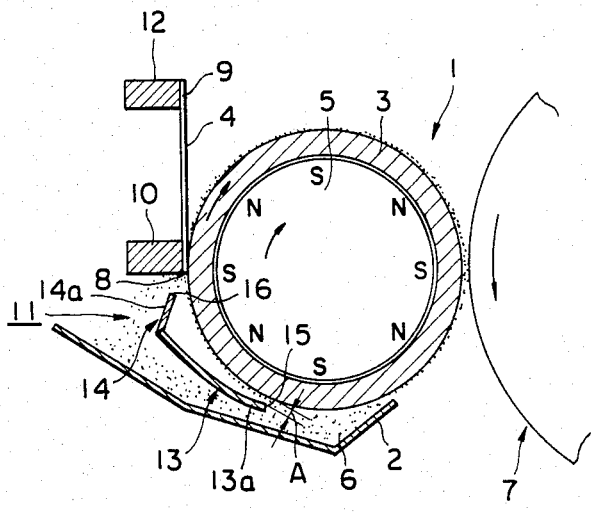

FIG. 4 shows another embodiment of the present invention which is capable of not only preventing toner particles from being deposited on the back side of the pressure plate 4 but also controlling the amount of toner particles which stay in the vicinity of the forward end 8 of the pressure plate 4 or in the entrance region leading to the gap between the pressure plate 4 and the developing sleeve 3. As shown, the structure of FIG. 4 includes a distribution control member 11 for controlling the distribution of toner particles 6 in the entrance region leading to the gap between the pressure plate 4 and the developing sleeve 3. In the embodiment shown in FIG. 4, the magnet roll 5 is driven to rotate in the same direction as the sleeve 3. The base end 9 of the pressure plate 4 is fixed to a support 12 which may be a part of the housing (not shown). The remaining structure is virtually the same as the structure shown in FIG. 2 and thus like numerals indicate like elements as practiced throughout the present specification.

The distribution control member 11 shown in FIG. 4 includes a first section 13 for limiting the amount of toner particles 6 supplied from the tank 2 and a second section 14 for removing the excessive amount of toner particles 6 from the region around the forward end 8 of the pressure plate 4. As shown, the supply amount control section 13 is comprised of a curved plate 13*a* of non-magnetic material which is disposed to extend generally in conformity with the peripheral surface of the developing sleeve 3; whereas, the excessive amount removing section 14 is comprised of an elongated plate 14*a* of magnetic material disposed in parallel with the longitudinal axis of the sleeve 3.

The curved plate 13 has a leading edge 15 located at a position to define a gap A with the peripheral surface of the sleeve 3 so that when the toner particles 6 are supplied from the tank 2 as driven by the rotation of the sleeve 3, the amount of the toner particles 6 transported by the sleeve 3 is controlled to a predetermined level by the gap A. This helps to keep the amount of toner particles 6 staying in the entrance region leading to the gap between the pressure plate 4 and the sleeve 3 at a predetermined level.

The magnetic plate 14*a* has its top edge 16 spaced apart with a predetermined gap from the developing sleeve 3 and located at a predetermined distance away from the forward end 8 of the pressure plate 4. In the region around the forward end 8, a periodically fluctuating magnetic field is produced by the rotation of the magnet role 5, so that the toner particles are driven out to be suspended in the air to float in the region around the top end 16 of the magnetic plate 14*a* thereby establishing the powder cloud state of the toner particles there. As a result, the toner particles 6 in the powder cloud state are partly removed from the entrance region and returned to the tank 2 due to the interacting magnetic field between the magnetic role 5 and the magnetic plate 14*a* thereby leaving a desired small amount of toner particles 6 in the entrance region or in the vicinity of the forward end of the pressure plate 4. Therefore, provision of the element 11 insures that an appropriate amount of toner particles 6 exists in the vicinity of the forward end 8 at all times, which contributes to form the toner film 6*a* of uniform thickness and charging. In FIG. 4, the elements 13*a* and 14*a* are shown to be connected, but they must be provided separately, if desired. Furthermore, in FIG. 4, the magnet role 5 is driven to rotate clockwise similarly with the sleeve 3. Clockwise rotation of the magnet role 5 causes the toner particles 6 to move counterclockwise along the peripheral surface of the sleeve 3; however, clockwise rotation of the sleeve 3 overcomes such a counterclockwise movement induced by the magnet role 5 to cause a net clockwise movement of the toner particles 6 after all.

Figure 5:
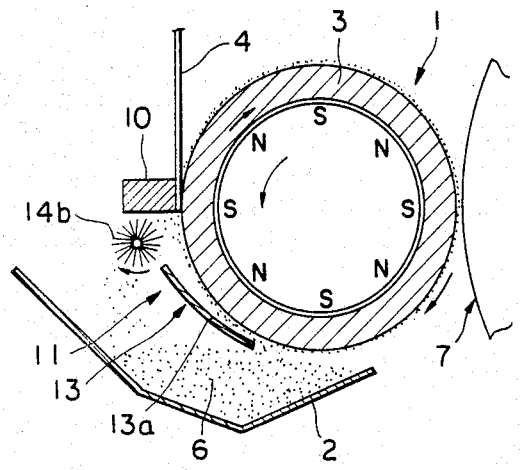

FIG. 5 shows a further embodiment of the present invention in which use is made of a rotating brush 14*b* instead of the magnetic plate 14*a*. In this embodiment, the brush 14*b* is driven to rotate to mechanically remove the excessive toner particles from the region around the forward end 8 of the pressure plate 4. Similarly, other structures such as a roller having a plurality of blades or an irregular surface may also be employed to carry out the desired function of removing the excessive toner particles.

It is to be noted that the pressure plate may be made wholly or partly of a magnetic material, and it may also be made of a non-magnetic material in which case a magnetic member must be movably disposed to be contactable with the back side of the pressure plate 4 so as to bring the pressure plate pressed against the sleeve 3 as attracted by the magnet role 5.

Figure 6:
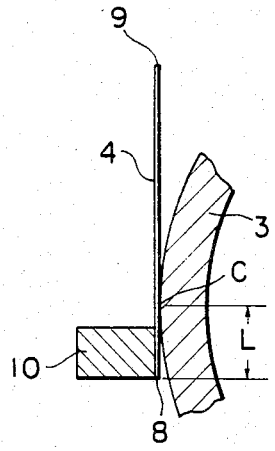
Figure 7:
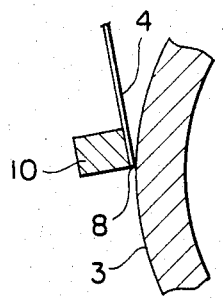

FIG. 6 shows a further embodiment of the present invention in which the pressure plate 4 is so arranged that its forward end 8 is located at the distance L below the contact line C between the pressure plate 4 and the sleeve 3. As will be described later, the projecting length L of the pressure plate 4 should be relatively short. FIG. 7 shows a still further embodiment of the present invention in which the pressure plate 4 is inclined with respect to the tangential direction at the contact line between the pressure plate 4, or its forward end 8, and the sleeve 3. In some cases, such an arrangement is preferred because it can make the resulting toner film 6*a* even more thinner.

It should also be noted that in the embodiments shown in FIGS. 4 and 5, the deposition preventing member 10 may be omitted as long as the distribution control member 11 functions to prevent the toner particles from being deposited on the back side of the pressure plate 4. In some cases, the curved plate 13 may also be omitted, in which case the distribution control member 11 is comprised only of the excessive amount removing section 14.

Figure 8:
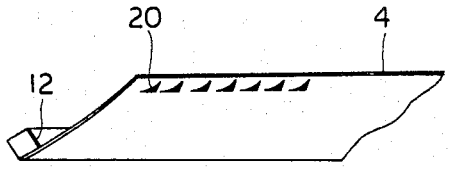
FIG. 8 is a fragmentary, perspective view of the pressure plate showing developer stuck portions in the shape of a triangle along the forward end thereof.

Referring back to FIG. 1, when the structure shown in FIG. 1 is operated, it might happen that toner particles become locally stuck to the pressure plate 4 from various reasons. For example, if the sleeve 3 is slightly eccentric, this could cause toner sticking 20 as shown in FIG. 8. These toner stuck sections 20 are usually formed in the vicinity of and along the contact line between the pressure plate 4 and the sleeve 3. The formation of these toner stuck sections 20 is disadvantageous because the toner film 6*a* becomes streaky and non-uniform in thickness.

Figure 9:
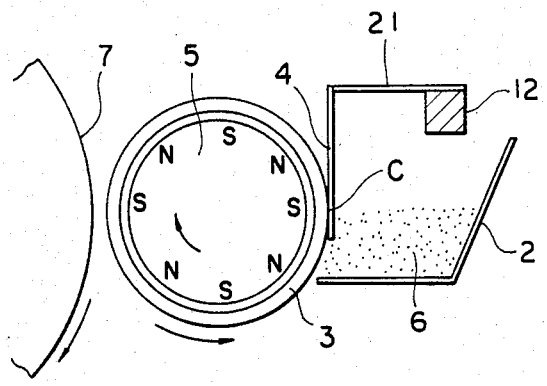
FIGS. 9 through 11 are schematic illustrations showing several embodiments of the present invention provided with oscillating means for preventing the formation of developer stuck portions shown in FIG. 8 thereby allowing to form a thin film of uniformly charged developer consistently.

FIG. 9 shows one embodiment of the present invention which is capable of preventing toner particles from being stuck to the pressure plate 4. As shown, the base-(or top) end of the pressure plate 4 is fixed to the free end of an elastic plate 21 whose base end is fixed to the support 12. Since the plate 21 is made of an elastic material, it may deflect in a cantilever fashion when a force is applied externally. The plate 21 may be as wide as the pressure plate 4, in which case, the entire free end of the plate 21 is fixed to the top end of the pressure plate 4.

In operation, when the magnet roll 5 is driven to rotate clockwise as indicated by the arrow in FIG. 9, the pressure plate 4 of magnetic material receives a force to move up and down along the tangential plane including the contact line C due to the rotating magnetic field created by the magnet roll 5. In addition, since the pressure plate 4 is pressed against the sleeve 3 with toner particles 6 sandwiched therebetween due to the magnetic attraction force exerted by the magnet roll 5, it also receives a dynamic frictional force. With these forces applied, the pressure plate 4 is forced into the state of vibration since the elastic plate 21 functions as a leaf spring. That is, the conditions of vibration, e.g., amplitude and frequency, of the pressure plate 4 are determined by the factors including spring constant of the leaf spring 21, strength of the magnetic force received by the pressure plate 4, dynamic frictional force received by the pressure plate 4, and rotational speed and mass of the pressure plate 4. After a transient time period, the steady state condition is established and the pressure plate 4 begins to execute a sinusoidal oscillation. It is important that the amplitude of such a sinusoidal oscillation be large enough to cause removal of the toner particles 6 sticking to the pressure plate 4. If the above-described factors are determined to satisfy this condition, the toner particles 6 are prevented from being stuck to the pressure plate 4, so that the toner film 6*a* may be formed uniform in thickness and charging reliably as well as consistently. This then allows to obtain a developed image of excellent quality.

Figure 10:
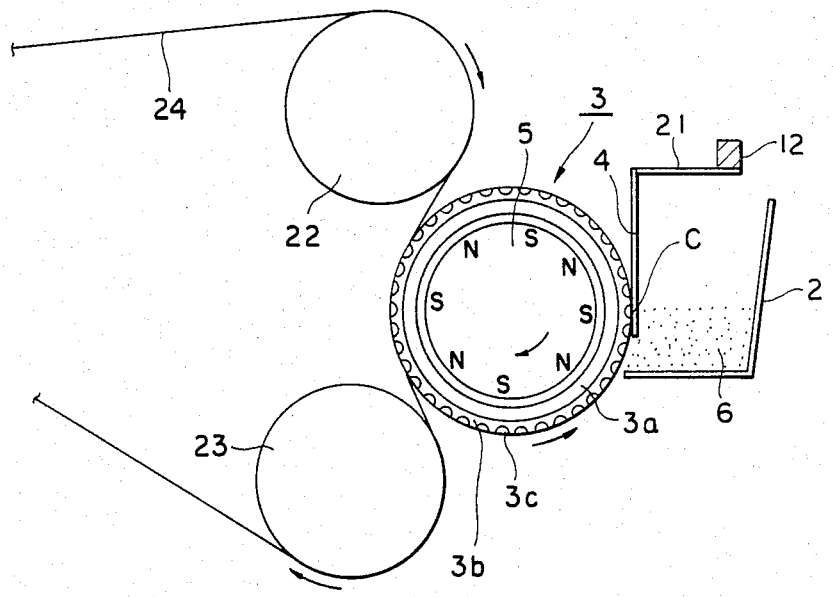

FIG. 10 shows a modification of the structure shown in FIG. 9. In FIG. 10, the developing sleeve 3 is comprised of a base layer 3*a*, a dielectric layer 3*b* formed on the base layer 3*a* and a plurality of floating electrodes 3*c* which are embedded in the dielectric layer 3*b* to be electrically isolated from each other and at least some of which are exposed at the outer peripheral surface. Moreover, instead of a photosensitive drum, use is made of a photosensitive belt 24 extending around driving rollers 22 and 23. The developing sleeve 3 is disposed between the driving rollers 22 and 23 such that the sleeve 3 makes a rolling contact under pressure with a portion of the photosensitive belt 24 thereby defining the developing region. The remaining structure is virtually the same as shown in FIG. 9. As will be described in detail later, developing performance can be significantly improved by using the sleeve 3 having the structure shown in FIG. 10.

In either of the embodiments shown in FIGS. 9 and 10, the pressure plate 4 may be made of a tempered magnetic spring material having 0.2 mm in thickness and 30 mm in length, and the elastic plate 21 may be made of an aluminum plate having 0.5 mm in thickness and 20 mm in length. The magnet roll 5 may have eight poles arranged along its circumference spaced apart from each other and alternating in polarity with producing the magnetic field strength of 1,000 Gauss at the position 2 mm above each of the poles. The ratio of the peripheral speed of the photosensitive member to the peripheral speed of the sleeve may be set in the range from 1:1 to 1:5 with the rotational speed of the magnet roll 5 set at 400 r.p.m. or more. With the above conditions, a developed image of excellent quality has been obtained. Incidentally, the length of that portion of the pressure plate 4 from the bottom end to the contact line C may be set 3 mm or less and the unit pressing force exerted by the pressure plate 4 against the sleeve 3 may be set at 40 grm. w./cm or less.

It is to be noted that the above specific examples are given only for the purpose of illustration and the present invention should not be limited thereto.

Figure 11:
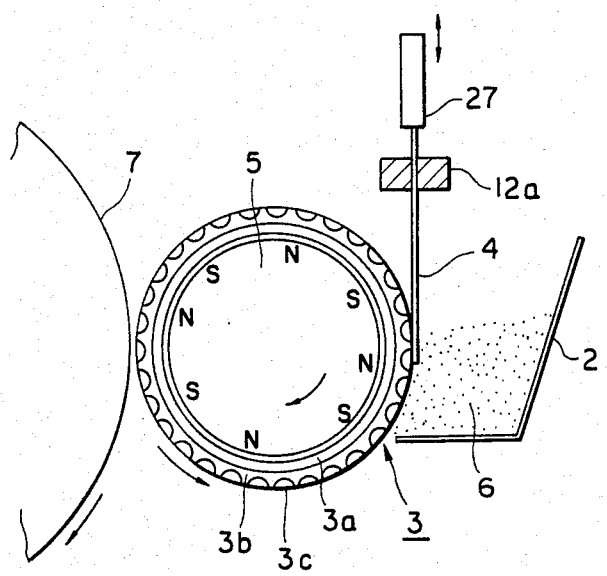

FIG. 11 shows a further embodiment of the present invention in which a separate vibrating mechanism 27 is provided to forcibly move the pressure plate 4 up and down periodically along the tangential plane defined at the contact line between the sleeve 3 and the pressure plate 4. The pressure plate 4 extends through a slot provided in the support member 12*a*. The vibrating mechanism 27 may be comprised of any well known means for causing a periodic oscillation. For exmaple, a combination of a motor and an eccentric cam, a combination of an electromagnet and a permanent magnet or any other combinations including a piezoelectric or magnetostrictive element may be used.

Figure 12:
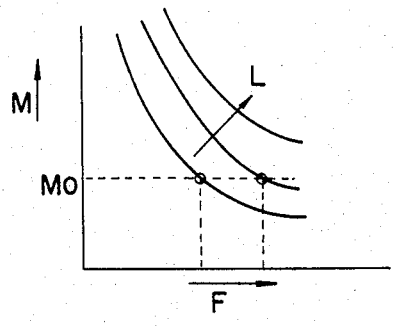
FIG. 12 is a graph showing the relation between the pressing force F applied by the pressure plate to the sleeve-shaped developer carrying member and the amount M of developer carried by the developer carrying member with the length L from the contact point between the developer carrying member and the pressure plate to the forward end of the pressure plate as a parameter.

As discussed with reference to FIG. 6, the pressure plate 4 may be so arranged to extend beyond the contact line C between the pressure plate 4 and the developing sleeve 3 with its forward end 8 located away from the contact line C by the lenght L. The amount M of toner particles 6 per unit area carried by the sleeve 3 predominantly depends on the pressing force F of the pressure plate 4 against the sleeve 3 and the length L between the forward end 8 and the contact line C. The relationships among F, L and M are shown graphically in FIG. 12 in which the abscissa is taken for pressing force F and the ordinate is taken for carried toner amount M showing length L as a parameter. As is obvious from the graph of FIG. 12, in order to obtain an optimum amount Mo, numerous combinations of L and F may be selected. In reality, however, since it is desirous to keep the toner particles 6 receiving less stress, it is preferable to select the values of L and F smaller to the extent not to cause instability in operation.

It has been found experimentally that a uniform toner layer in the order of the diameter or twice the diameter of an average single toner particle can be obtained under the following conditions. Use is made of single component magnetic toner particles having the average diameter of 12 microns or less and the volume resistivity of $10^{13}$ ohm.cm or more. Use is made of the sleeve 3 having the structure illustrated in FIG. 10 with the base layer 3*a* comprised of stainless steel. Use is made of the magnet roll 5 including eight poles arranged around the circumference spaced apart from each other and alternating in polarity, each pole having the magnetic strength of 1,500 Gauss. The magnet roll 5 is driven to rotate at 1,800 r.p.m., and the sleeve 3 is driven to rotate at 120 r.p.m. The pressure plate 4 is made from a magnetic spring plate having the thickness of 0.2 mm and the length of 30 mm. The length L is set to be 3 mm or less and the pressing force F per unit length is set to be 40 grm.w./cm or less. Using the toner film 6*a* formed under the above-described conditions to develop an electrostatic latent image formed the photosensitive member, a developed image of excellent quality has been obtained.

Figure 13:
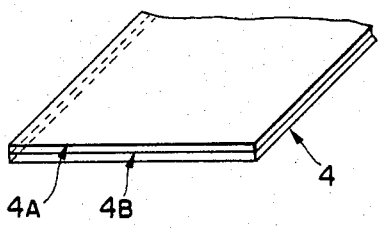
FIG. 13 is a fragmentary, perspective view showing the structure of one example of the pressure plate to be used in the present invention.

As shown in FIG. 13, the pressure plate 4 may have a laminated structure rather than a single plate structure. In the embodiment of FIG. 13, the pressure plate 4 includes a magnetic plate $4_A$ and a non-magnetic plate $4_B$, which are combined together.

Figure 14:
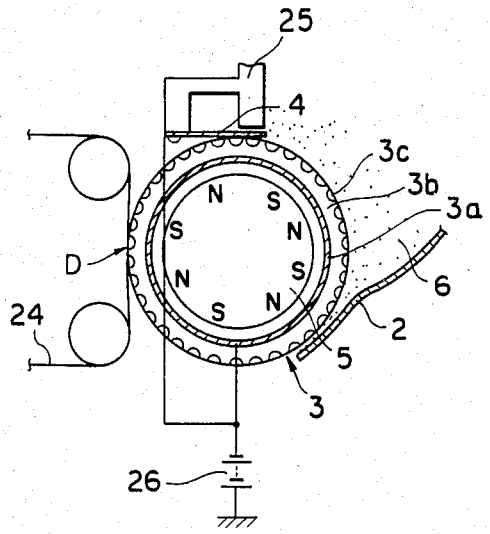
FIG. 14 is a schematic illustration showing a further developing device constructed in accordance with the present invention, which is provided with a particular biasing scheme to further improve developing parformance.

FIG. 14 shows a further embodiment of the present invention in which the pressure plate 4 is disposed above the developing sleeve 3. One end of the pressure plate 4 is fixed to a holding member 25 which in turn is fixed to a machine housing (not shown). It is to be noted that the pressure plate 4 is disposed with its forward end pressed against and directed in the direction counter to the rotating direction of the developing sleeve 3, and thus pressure plate 4 has the function similar to what has been described above with respect to the other embodiments. The developing sleeve 3 of FIG. 14 is similar in structure to the sleeve 3 of FIG. 10, and it includes a base layer 3*a* of electrically conductive material, a dielectric layer 3*b* formed on the base layer 3*a* and a plurality of floating electrodes 3*c* embedded in the dielectric layer 3*a* and partly exposed at the peripheral surface of the sleeve 3. Also provided is a voltage supply 26 to apply a predetermined bias potential to the base layer 3*a* of the sleeve 3 and also to the pressure plate 4.

Figure 15:
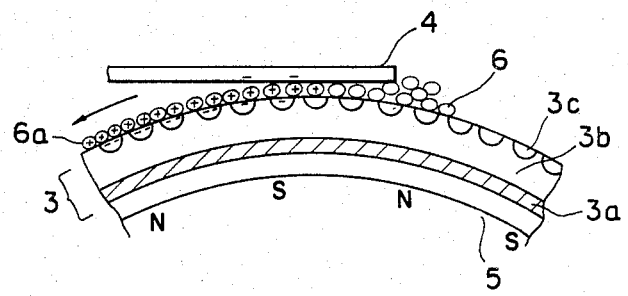
FIG. 15 is a fragmentary view on an enlarged scale showing a part of the structure shown in FIG. 14.

Referring now to FIG. 15 showing on an enlarged scale a part of the structure shown in FIG. 14, as the sleeve 3 is driven to rotate, the toner particles 6 carried as attracted to the peripheral surface of the sleeve 3 are forced into the gap between the pressure plate 4 and the sleeve 3 to be rearranged thereby forming a thin film of toner particles. During this rearrangement, the toner particles 4 become charged because of frictional charging with the pressure plate 4, with the floating electrodes 3*c*, or with the dielectirc layer 3*b*. As a reault, the floating electrodes 3*c* come to bear charges same in magnitude as but opposite in polarity to the charges of the toner film. In this instance, if a potential difference exists between the pressure plate 4 and the base layer 3*a*, since the surface potential of the sleeve 3 on which the toner film 6*a* has been formed becomes equal to the potential of the pressure plate 4, the same potential difference will exist between the toner film 6*a* and the base layer 3*a* in the developing region. This is disadvantageous and the developing performance tends to be deteriorated. The embodiment of FIG. 14 does not suffer from such a disadvantage since the base layer 3*a* is maintained at the same potential as the pressure plate 4.

Strictly speaking, however, in view of the fact that there is a potential drop across the toner film 6*a*, the potential to be applied to the pressure plate 4 should be set somewhat lower than the potential to be applied to the base layer 3*a*. However, in practice, the potential drop across the toner film 6*a* may be neglected partly because it is relatively thin. In the event where the potential drop across the toner film 6*a* is critical, an appropriate voltage supply or a constant voltage element may be inserted between the pressure plate 4 and the base layer 3*a* or ground, as is obvious for those skilled in the art.

Figure 16:
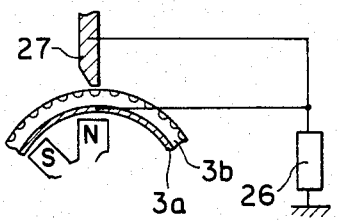
FIGS. 16 and 17 are schematic illustrations showing modifications of the structure of FIG. 14.
Figure 17:
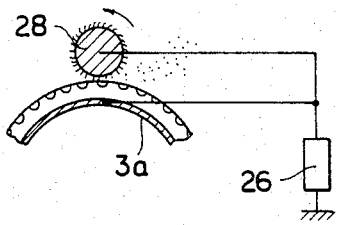

FIGS. 16 and 17 show modifications of the embodiment of FIG. 14. Instead of the pressure plate 4, use is made of a stationary blade 27 as a means for forming a toner film; on the other hand, use is made of a rotating brush 28 in FIG. 17. In either case, the blade 27 and the brush 28 are maintained at the same potential as that of the base layer 3*a*.

Figure 18:
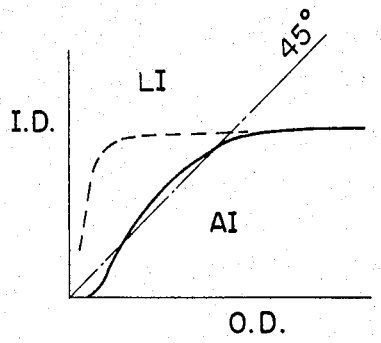
FIG. 18 is a graph showing ideal developing characteristics for line images LI and area images AI with the abscissa taken for the density of an original image (0.D.) and the ordinate taken for the density of a developed image(I.D.)

Now, in reproduction technology, depending on whether an original image is a line image such as a document or an area image such as a picture, differing reproducing characteristics are commonly required. In other words, in the case where an original image to be reproduced is an area image, it is usually desired that the continuous tone of the original image be reproduced as it is; on the other hand, in the case where an original image to be reproduced is a line image such as characters and diagrams, it is usually desired that all of the lines be reproduced bold and clear even if lines are rather hazy in the original image. These differing requirements for line and area images are graphically show in FIG. 18 in which the abscissa is taken for the density (O.D.) of an original image to be reproduced and the ordinate is taken for the density (I.D.) of a reproduced or developed image. The desired characteristics for line and area images are shown by the dotted(LI) and solid(AI) curves, respectively. As shown, the characteristic for an area image as a whole has a slope of approximately 45 degrees; whereas, the characteristic for a line image has a much steeper slope, indicating that hazy lines are converted into clear lines by reproduction.

Figure 19:
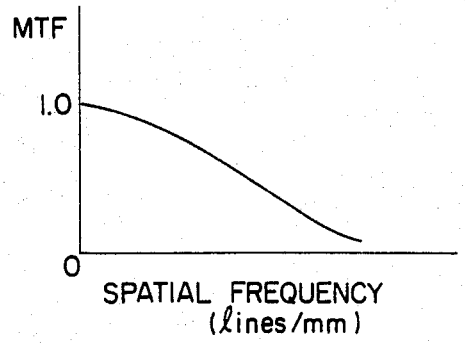
FIG. 19 is a graph showing a typical transmission curve of the exposure system of a copying machine as a function of spatial frequency of an image.

On the other hand, the exposure system of a copying machine, in general, has a characteristic in that the transmission function(MTF) of tone of an image to be transmitted from an original document to a photosensitive member varies as a function of the spatial frequency of the image as shown in FIG. 19. The graph of FIG. 19 has its abscissa taken for the spatial frequency and the ordinate taken for MTF. For zero spatial frequency, or an area image, MTF is 1.0 and thus the contrast of an original image is transferred to a photosensitive member without changes. On the other hand, as the spatial frequency increases, or lines become thinner, the value of MTF decreases, causing the latent image formed on the photosensitive member lower in contrast. That is, the latent image of a line image is lower in potential than the latent image of an area image. Thus, the latent image of a line image is required to be developed with higher concentration.

Figure 20:
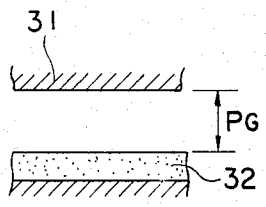
FIG. 20 is a schematic illustration showing the spatial arrangement at the developing region.
Figure 21:
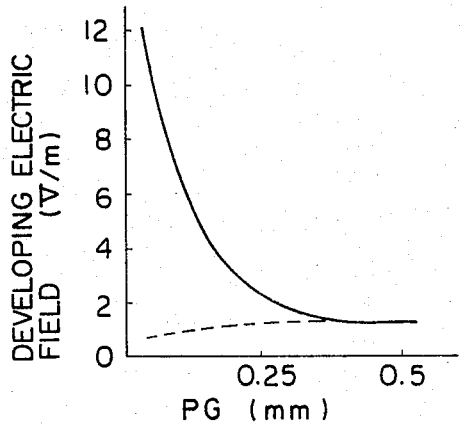
FIG. 21 is a graph showing typical characteristics for area and low contrast line images between the photosensitive member-to-developing electrode distance and the field strength at the surface of the photosensitive member.

FIG. 20 schematically illustrates the developing region in which a developing sleeve or electrode 31 is positioned opposite to a photosensitive member 32 with a gap distance $P_G$ therebetween. Given that 200 V. is applied to the developing electrode 31 and that the photosensitive member 32 has dielectric constant of 3.0 and thickness of 20 microns, the field strength at the surface of the photosensitive member 32 has been calculated by forming various charge patterns on the surface of the photosensitive member 32 with the use of a computer simulation, and the results are plotted in the graph of FIG. 21, in which the abscissa is taken for the gap distance $P_G$ between the developing electrode 31 and the photosensitive member 32 and the ordinate is taken for the strength of a developing electric field. In FIG. 21, the solid line indicates a characteristic for an area image and the dotted line for a line image of low contrast having 5 lines/mm of spatial frequency. Incidentally, 800 V. of charging potential and 200 V. of background potential have been assumed.

Figure 22A:
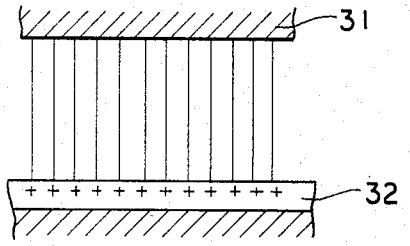
FIGS. 22(*a*) and (*b*) are schematic illustrations showing the electric field created by area and line images, respectively, between the photosensitive member and the developing electrode.
Figure 22B:
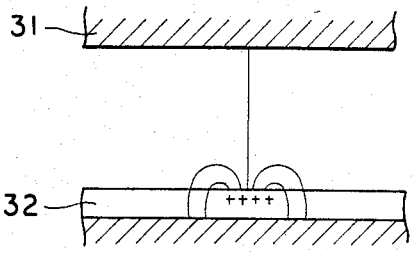

As shown in FIG. 21, the developing electric field rapidly increases its strength as the gap distance $P_G$ becomes smaller in the case of a black area image; on the other hand, only minor changes occur in the case of a line image. The reason for such a difference will be well appreciated by referring to FIGS. 22(*a*) and (*b*). That is, in the case of an area image, charges are distributed across a relatively wide surface region of the photosensitive member 32 so that a substantially parallel electric field is created between the developing electrode 31 and the photosensitive member 32, as shown in FIG. 22(*a*). On the other hand, in the case of a line image, charges are locally distributed in the surface of the photosensitive member 32 so that only some of the electric force lines emanating from the charges reach the developing electrode 31 and most of the electric force lines are directed to the adjacent background portions, causing concentration of field lines along the contour of the line image which is commonly called the "edge effect", as shown in FIG. 22(*b*).

As is apparent from FIG. 21, in order to reproduce a line image of low contrast having 5 lines/mm of spatial frequency and 0.D. = 0.2 with the reproduced density of approximately $\frac{1}{2}$ of the saturation density of a black area image, the gap distance $P_G$ must be selected to be approximately 0.2 mm. However, in the case where the toner film 6*a* is very thin and in the order of 10 s of microns as in the present invention, an unacceptably large gap will be formed between the surface of the toner film and the surface of the photosensitive member.

Figure 23:
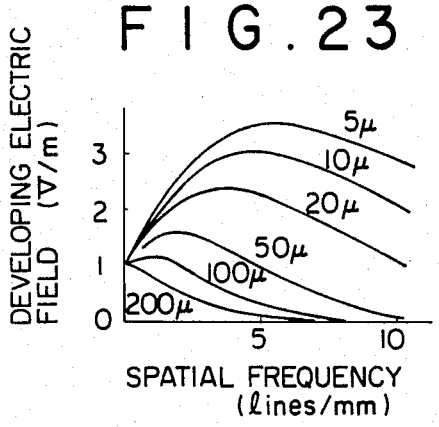
FIG. 23 is a graph showing the typical relation between the spatial frequency of an image to be developed and the developing electric field with a distance from the photosensitive member as a parameter.

It will now be considered how the magnitude of electric field will vary depending upon the distance from the surface of the photosensitive member. FIG. 23 shows the relation between the spatial frequency and the developing electric field with the distance from the surface of the photosensitive member as a parameter for the gap distance $P_G = 0.5$ mm. As can be understood from FIG. 23, in the close proximity of the photosensitive member, a line image (for example, 5 lines/mm) is more enhanced than an area image (0 lines/mm); however, as separated further away from the surface of the photosensitive member, the electric field of a line image decreases its strength rapidly. Accordingly, if development were carried out with a relatively large gap between the toner film and the photosensitive member, reproducibility of a line image would be significantly deteriorated.

Figure 24:
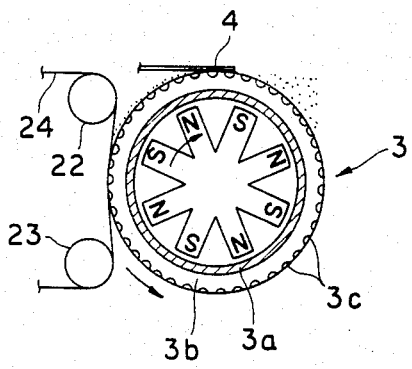
FIG. 24 is a schematic illustration showing a developing device including a sleeve-shaped developer carrier member having floating electrodes which are embedded in a dielectric layer and at least some of them are exposed at the peripheral surface.
Figure 25:
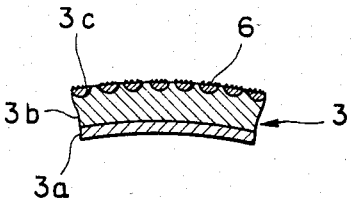
FIG. 25 is a fragmentary view on an enlarged scale showing a part of the sleeve-shaped developer carrier member employed in FIG. 24.

The above-addressed problem may be obviated by using a developing sleeve having a particular structure. Such a developing sleeve 3 is shown in detail in FIGS. 24 and 25, and it is to be noted that the developing sleeve 3 having such a structure is also used in FIGS. 10, 11 and 14, 16 and 17. As shown in FIGS. 24 and 25, the developing sleeve 3 includes a conductive base layer 3*a*, a dielectric lay 3*b* formed on the base layer 3*a* and a plurality of floating electrodes which are embedded in the dielectric layer 3*b* and partly exposed at the outer peripheral surface. The floating electrodes 3*c* are electrically isolated from one another and from the conductive base layer 3*a*. When the floating electrodes 3*c* are brought into the electric field produced by a line image as shown in FIG. 22(*b*), it has a remarkable effect of making the dielectric thickness of the gap between the developing electrode 31 and the photosensitive member 32 extremely smaller. On the other hand, in the case of the parallel electric field produced by an area latent image as shown in FIG. 22(*a*), presence of the floating electrodes 3*c* has a very little effect and the dielectric thickness is reduced only slightly. Therefore, both of line and area images may be reproduced appropriately by using the developing sleeve 3 having the structure shown in FIGS. 24 and 25.

In the arrangement shown in FIG. 24, use is made of a photosensitive belt 24 as a means for carrying an electrostatic latent image. Use of the photosensitive belt 24 is advantageous because it may be brought into close contact with the floating electrodes 3*c* with the toner film sandwiched therebetween, thereby allowing to obtain a developed image of excellent quality. However, difficulty will be encountered to obtain such a close contact if use is made of a drum type photosensitive member.

Figure 26:
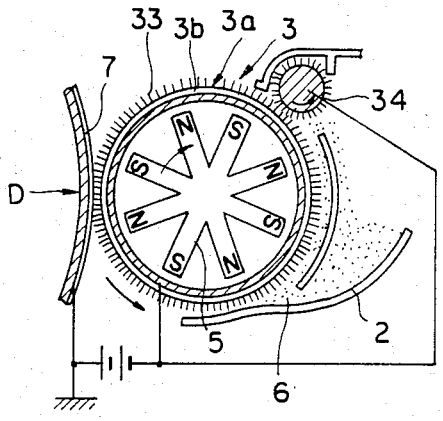
FIG. 26 is a schematic illustraion showing a developing device including a sleeve-shaped developer carrier member having conductive bristles planted in the peripheral surface electrically isolated one from another.

FIG. 26 shows an arrangement which allows to use a drum type photosensitive member without lowering developing efficiency. As shown, disposed in the neighborhood of the photosensitive drum 7 is the developing sleeve 3 which includes the conductive base layer 3*a*, the dielectric layer 3*b* formed on the base layer 3*a* and a plurality of conductive and flexible fibers 33 planted across the surface of the dielectric layer 3*b* such that they are electrically isolated from one another. The sleeve 3 is driven to rotate counter-clockwise and inside the sleeve 3 is disposed the magnet roll 5 having eight magnetic poles arranged in alternating polarity along the circumference of the roll 5. The magnetic roll 5 is driven to rotate clockwise. The magnetic toner particles 6 are stored in the tank 2 and they are attracted onto the sleeve 3 and carried thereon as the sleeve 3 rotates. A rotating brush 34 is provided to control the amount of toner particles 6 carried by the sleeve to the developing region D.

With the arrangement shown in FIG. 26, the conductive fibers 33 function as the floating electrodes 3*c* in the arrangement of FIG. 24. Furthermore, since the fibers 33 are flexible, they may be brought into close contact with the surface of the photosensitive member 7 even if it is of the drum type. Therefore, line and area latent images formed on the photosensitive drum 7 may be developed with respectively desired characteristics with the arrangement of FIG. 26. It should further be noted that the fibers 33 may function to remove unwanted toner particles from the background region.

Now, a method of manufacturing the sleeve 3 of FIG. 26 will be described hereinbelow.

First, a cylinder of stainless steel is prepared as the base support 3*a*. An epoxy resin layer is formed on the cylinder 3*a* to the thickness of approximately 500 microns by any well known powder coating method, and, after baking, the epoxy resin layer is ground to form the dielectric layer 3*b* of uniform thickness of 300 microns Then, after appliying an epoxy adhesive uniformly to the peripheral surface of the dielectric layer 3*b* to the thickness of 10 s of microns, conductive fibers are electrostatically planted into the adhesive. Preferably, the conductive fibers have the length ranging from approximately 0.5 mm to approximately 2.0 mm. The resulting sleeve structure is such that a dielectric layer is formed on the outer peripheral surface of a conductive cylinder and a plurality of conductive fibers are planted in the dielectric layer electrically isolated from one another and also from the conductive cylinder.

A description will now be made as to an example of developing an electrostatic latent image using the developing sleeve manufactured as described above. The toner particles employed in this example have the average diameter of 6.8 microns and 40 weight % of magnetic material contents.

The toner particles 6 are supplied from the tank 2 and attracted to the peripheral surface of the sleeve 3 to magnetic attraction. Then, as the sleeve 3 rotates to carry the thus attracted toner particles in the counter-clockwise direction, the excessive toner particles are removed by the rotating brush 34 thereby the toner film comprised of approximately a single layer of toner particles is formed on the sleeve 3 in the down stream of the brush 34, which may be comprised of stainless steel. As shown in FIG. 26, the same potential is applied not only to the base layer 3*a* but also to the brush 34. The effect of such a biasing scheme has already been described with reference to FIG. 14.

Because of friction with the fibers 33 and/or the brush 34, the toner particles on the sleeve 3 become negatively charged. These charged toner particles are then selectively attracted to the surface of the photosensitive drum 7 depending on the pattern of an electrostatic latent image formed thereon when they are brought into the developing region D. It is to be noted that to the developing sleeve 3 is applied a bias potential which is approximately the same as the background potential of the latent image formed on the photosensitive drum 7.

After development, a visualized toner image is then transferred to a transfer material such as plain paper by means of a transferring device(not shown) and the transferred image is fixed to the transfer material.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A developing device for developing an electrostatic latent image by bringing a film of developer close to said latent image, said device comprising:

a tank for containing therein a quantity of developer;

developer carrying means for carrying thereon said developer, said developer carrying means being driven to move along a predetermined path including a developing region where said electrostatic latent image is developed by said developer;

means for attracting said developer to said developer carrying means;

means for forming a film of developer having a predetermined thickness on said developer carrying means after said developer, supplied at least partly from said tank, has been attracted to said developer carrying means, said means for forming being disposed in the upstream of said developing region and including a pressure plate having a base end supported by a housing of said device and a forward end pressed against said developer carrying means such that said forward end is directed against the direction of movement of said developer carrying means at the points of contact; and means for controlling the amount of said developer to be supplied to said means for forming.

2. A developing device as in claim 1 wherein said developer carrying means includes a rotatably supported sleeve having an outer peripheral surface which defines the path along which said developer is carried.

3. A developing device as in claim 2 wherein said means for attracting includes a magnet roll having appropriate number of magnetic poles and disposed inside said sleeve, and said pressure plate is pressed against the peripheral surface of said sleeve due to the magnetic attractive force exerted by said magnet roll.

4. A developing device as in claim 3 wherein said magnet roll is driven to rotate in a predetermined direction.

5. A developing device as in claim 3 wherein said pressure plate is comprised of a magnetic material.

6. A developing device as in claim 2 wherein said means for controlling includes a deposition preventing member for preventing said developer from being deposited on the back side of said pressure plate.

7. A developing device as in claim 6 wherein said deposition preventing member includes a block having a predetermined size and provided on the back side of and at the forward end of said pressure plate.

8. A developing device as in claim 7 wherein said block is formed integratly with said pressure plate.

9. A developing device as in claim 2 wherein said means for controlling includes a first section for limiting the amount of said developer to be carried as attracted to the peripheral surface of said sleeve from said tank, said first section being disposed in the upstream of said pressure plate.

10. A developing device as in claim 9 wherein said first section includes a curved plate disposed to extend generally in conformity with the peripheral surface of said sleeve, said curved plate having a leading edge positioned to define a predetermined gap with the peripheral surface of said sleeve thereby limiting the amount of said developer to be carried as attracted to the peripheral surface of said sleeve.

11. A developing device as in claim 3 wherein said means for controlling includes a second section for removing the excessive amount of said developer from the region around said pressure plate.

12. A developing device as in claim 11 wherein said second section includes a magnetic plate disposed as a predetermined position, said magnetic plate producing an interacting magetic field in cooperation with said magnet roll to cause the excessive amount of said developer removed from the region around said pressure plate.

13. A developing device as in claim 11 wherein said second section includes a rotating brush disposed at a predetermined position for removing the excessive amount of said developer removed from the region around said pressure plate.

14. A developing device as in claim 11, 12 or 13, wherein said region around said pressure plate is the entrance region to the contact line between said pressure plate and said sleeve.

15. A developing device for developing an electrostatic latent image by bringing a film of developer comprised of magnetic toner particles closer to said latent image, said device comprising:

a tank for containing therein a quantity of magnetic toner particles;

a developing sleeve driven to rotate in a predetermined direction having an outer peripheral surface on which said tones particles may be carried;

means for forming a fluctuating magnetic field along the peripheral surface of said developing sleeve;

a pressure plate having a base end and a forward end which is pressed against the peripheral surface of said developing sleeve and directed counter to the rotating direction of said developing sleeve; and means for vibrating said pressure plate.

16. A developing device as in claim 15 wherein said means for forming a fluctuating magnetic field includes a magnet role having an appropriate number of magnetic poles disposed inside of said developing sleeve.

17. A developing device as in claim 16 wherein said magnet role is driven to rotate in a predetermined direction.

18. A developing device as in claim 17 wherein said pressure plate is comprised of a magnetic material and said means for vibrating includes a leaf spring having a free end which is fixedly connected to the base end of said pressure plate and an opposite end fixedly supported by the housing of said device.

19. A developing device as in claim 15 wherein said means for vibrating includes an oscillating mechanism which supports the base end of said pressure plate for keeping said pressure plate in vibration.

20. A developing device for developing an electrostatic latent image by bringing a film of developer closer to said latent image, said device comprising:

a tank for containing therein a quantity of developer;

a developing sleeve driven to rotate in a predetermined direction having an outer peripheral surface on which said developer may be carried, said sleeve including a conductive base layer, a dielectric layer formed on said conductive base layer and a plurality of floating electrodes provided at least at the peripheral surface of said sleeve, means for attracting said developer to the peripheral surface of said developing sleeve;

means for forming a film of said developer of a predetermined thickness on the peripheral surface of said developing sleeve before application to said latent image; and means for applying a predetermined potential to said conductive base layer of said developing sleeve and also to said means for forming a film.

21. A developing device as in claim 20 wherein said means for forming a film includes a pressure plate comprised of an electrically conductive material, said pressure plate having a forward end pressed against the peripheral surface of said developing sleeve and directed counter to the rotating direction of said developing sleeve and receiving said predetermined potential.

22. A developing device as in claim 20 wherein said floating electrodes are embedded in said dielectric layer and at least partly exposed at the surface of said sleeve.

23. A developing device as in claim 20 wherein said floating electrodes are comprised of a plurality of conductive fibers partly planted in said dielectric layer.

* * * * *